US007328699B2

(12) United States Patent
Kawashima et al.

(10) Patent No.: US 7,328,699 B2
(45) Date of Patent: Feb. 12, 2008

(54) DIVING MASK

(75) Inventors: Haruo Kawashima, Tokyo (JP); Taro Fujima, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 393 days.

(21) Appl. No.: 11/088,753

(22) Filed: Mar. 25, 2005

(65) Prior Publication Data

US 2005/0217670 A1 Oct. 6, 2005

(30) Foreign Application Priority Data

Mar. 30, 2004 (JP) ..... 2004-099631

(51) Int. Cl.
*B63C 11/02* (2006.01)
*B62B 18/10* (2006.01)

(52) U.S. Cl. ..... 128/201.27; 128/201.28

(58) Field of Classification Search ..... 128/201.11, 128/201.27, 201.28, 205.24, 206.29; 405/186, 405/187; 2/426, 428, 427; 351/41, 43, 156, 351/157

See application file for complete search history.

(56) References Cited

U.S. PATENT DOCUMENTS 3,059,637 A * 10/1962 Louis ..... 2/9
5,231,982 A * 8/1993 Harrison et al. ..... 128/207.12
5,564,130 A * 10/1996 Feng ..... 2/428
5,638,552 A * 6/1997 Fujima ..... 2/428
5,890,234 A 4/1999 Lan
5,937,850 A * 8/1999 Kawashima et al. ... 128/201.11
5,979,441 A 11/1999 Hsieh
6,230,705 B1 * 5/2001 Kuo ..... 128/201.11

* cited by examiner

*Primary Examiner*—Teena Mitchell
(74) *Attorney, Agent, or Firm*—Clark & Brody

(57) ABSTRACT

A diving mask includes a nose cover and a valve seat of a drainage mechanism having a check valve formed in the vicinity of the nose cover. The nose cover and the value seat are formed from an elastic material which is integral with a soft elastic material forming the nose cover. In the vicinity of the valve seat, an annular member formed from a plastic material plastics having a hardness and deformation-resistance both higher than those of the elastic material forming the valve seat is embedded in a bottom of the nose cover so as to extend along the valve seat.

4 Claims, 6 Drawing Sheets

DIVING MASK

BACKGROUND OF THE INVENTION

The present invention relates to a diving mask and more particularly to a diving mask having a drainage mechanism provided with a check valve.

Diving masks are well known which have a drainage mechanism provided with a check valve. For example, U.S. Pat. No. 5,890,234 (Reference 1) and U.S. Pat. No. 5,979,441 (Reference 2) disclose a diving mask comprising a nose cover formed integrally with a skirt member and an annular member attached to a bottom of the nose cover. The annular member includes a plurality of drain holes and a check valve adapted to be opened outward with respect to these drain holes. The check valve is normally held in close contact with a valve seat formed on the annular member. The annular member is previously formed using material different from material for the skirt member and set in a die when the skirt member is molded in this die so that the annular member may be integrated with the skirt member.

Conventionally, the annular member including the valve seat is formed using a plastic or metallic material is a relatively hard and deformation-resistant while the skirt member is formed using a soft and elastic rubber-like material. The annular member is provided with an annular projection having a height in a range of about 0.3 to about 0.5 mm serving as the valve seat. Generally, such annular member is set in the die used to mold the skirt member at a predetermined position of the die. Molten plastic material is injected at a high pressure into the closed die to obtain the skirt member including the nose cover integrated with the annular member. However, such a process of molding the skirt member may be often accompanied with a problem such that the molten plastic material flows to the annular member and partially covers the valve seat. Obviously, the valve seat should not be covered with the plastic material. The amount of the plastic material partially covering the valve seat in this manner refers to as flash and it is impossible to ensure that the check valve is normally held in close contact with the valve seat so far as such flash is not removed.

SUMMARY OF THE INVENTION

In view of the problem as has been described above, it is an object of the present invention to improve the conventional diving mask having the drain holes provided with the check valve so that the close contact between the check valve and the valve seat may be easily and reliably obtained.

The object set forth above is achieved, according to the present invention, by an improvement in a diving mask having a back-and-forth direction, a transverse direction and a vertical direction being orthogonal one to another, and comprising: a lens unit including one or more lenses formed from a soft and transparent material and located ahead in the back-and-forth direction; a skirt member formed from a soft elastic material and extending rearward from the lens unit and a head-strap member adapted to hold a peripheral edge of the skirt member in close contact with the face of a wearer, the skirt member being formed in a region corresponding to a middle region of the lens unit as viewed in the transverse direction with a nose cover; and a drainage mechanism including a check valve adapted to be opened toward an outside of the skirt member being formed in a bottom of the nose cover or in a vicinity of the nose cover.

The improvement according to the present invention is as follows: The drainage mechanism comprises an inner annulation defining a through-hole adapted to receive a mounting shaft of the check valve, a plurality of drain holes defined around the inner annulation by a plurality of spokes radially extending from the inner annulation and a valve seat extending in a circumferential direction of the inner annulation outside an array of the drain holes and projecting toward the check valve. The valve seat is formed from an elastic material integrated with the soft elastic material forming the skirt member. An annular member formed from one of a plastic material and a metallic material having a hardness and deformation-resistance both higher than those of the elastic material forming the valve seat is embedded in the bottom of the nose cover in a vicinity of the valve seat so as to extending along the valve seat.

According to one preferred embodiment of the present invention, the inner annulation of the drainage mechanism has the through-hole formed from the same hard material as the material forming the annular member so that the hard material constituting the inner annulation is connected with the annular member by means of the hard material extending along the spokes.

In the diving mask according to the present invention, the valve seat cooperating with the check valve is formed from the elastic material which is integrated with the elastic material used for the skirt member. This unique arrangement reliably eliminates the possibility that the elastic material used to form the skirt member might cover the valve seat in the form of flash. Furthermore, the through-hole and the annular member of the drainage mechanism can be formed at once from the hard material by connecting such hard material constituting the inner annulation with the annular member formed from the hard material extending along the spokes.

DETAILED DESCRIPTION OF THE PREFERRED EMBODIMENTS

Details of a diving mask according to the present invention will be more fully understood from the description given hereunder with reference to the accompanying drawings.

Figure 1:
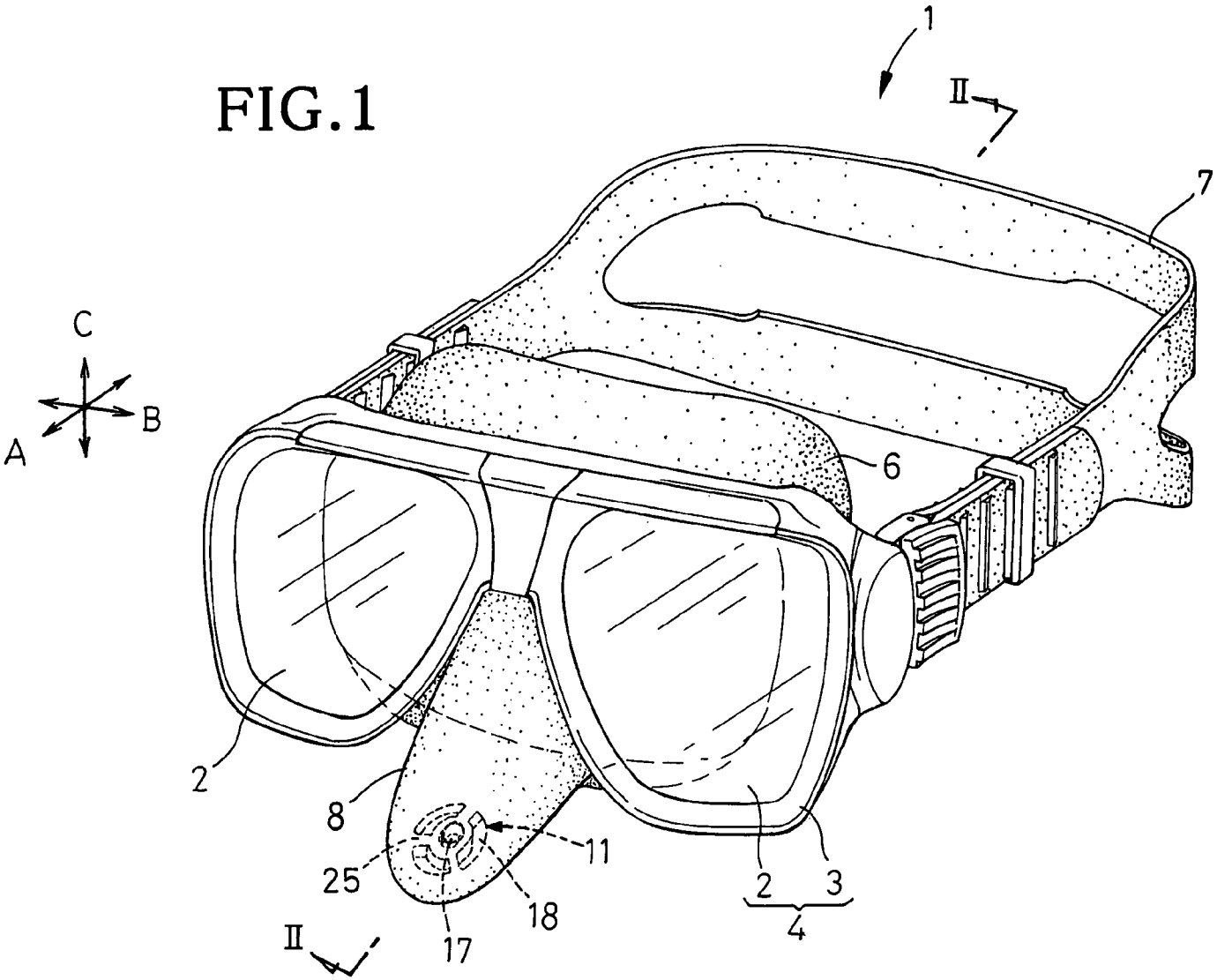
FIG. 1 is a perspective view showing a diving mask as an embodiment of the invention.

A diving mask 1 shown in FIG. 1 in a perspective view has a back-and-forth direction, a transverse direction and a vertical direction as indicated by double-headed arrows A, B and C, respectively, which are orthogonal one to another. The mask 1 comprises a lens unit 4 including a pair of lenses 2 and a lens frame 3 serving to hold peripheral edges of these lenses 2, a skirt member 6 extending rearward from the lens unit 4, and a head-strap member 7 extending rearward from transversely opposite side edges of the lens unit 4. The skirt member 6 is formed with a nose cover 8 extending forward from a transverse middle of the lens unit 4. The nose cover 8 is formed with a drainage mechanism 11 indicated by chain lines. Of such mask 1, the lenses 2 are formed from a transparent hard material, for example, plastics such as a polycarbonate resin or inorganic glass, the lens frame 3 is formed from plastics such as a polypropylene resin, nylon resin, polycarbonate resin and ABS resin. The skirt member 6 and the head-strap member 7 are formed, for example, by an elastomer such as a silicon rubber or natural rubber.

Figure 2:
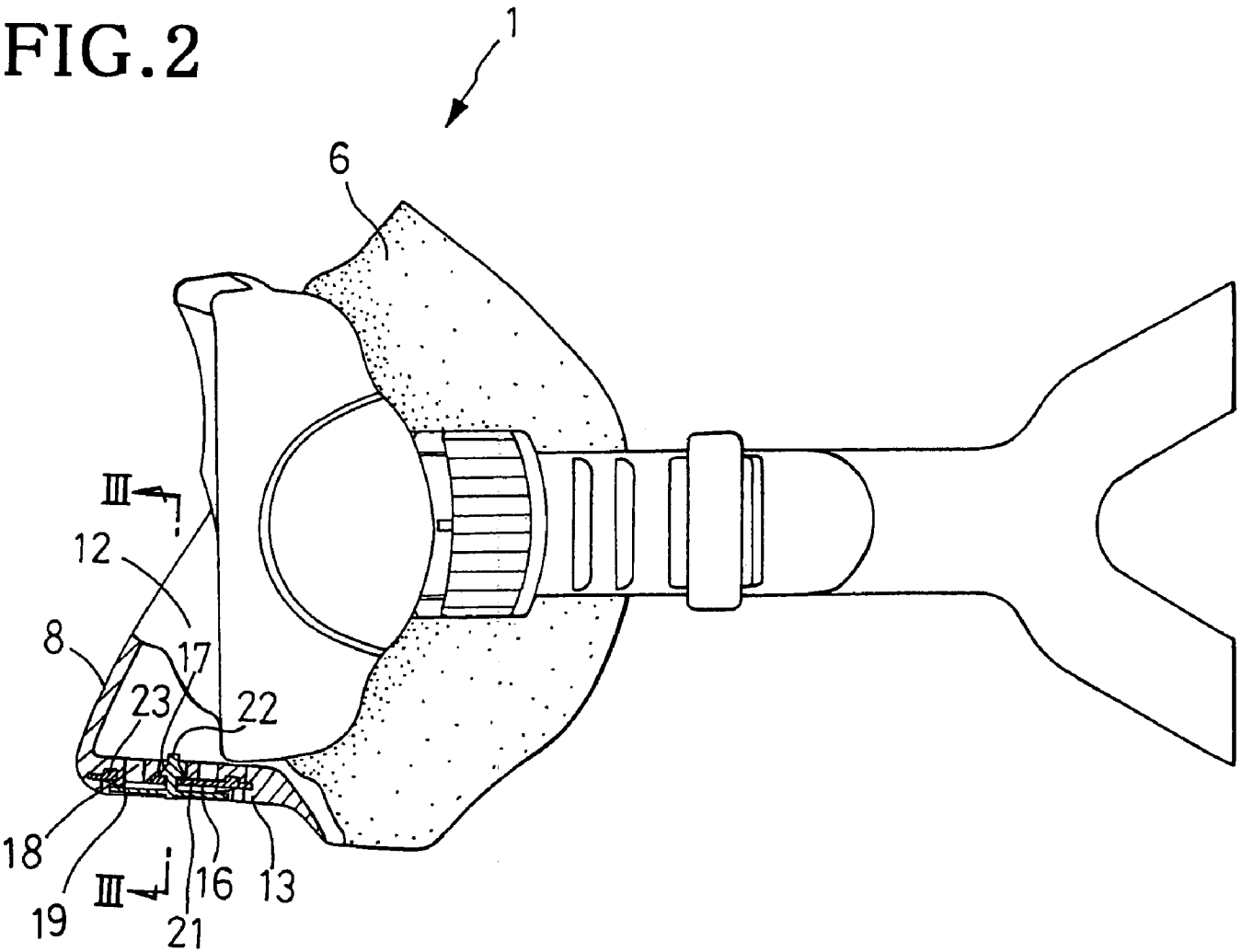
FIG. 2 is a partially cutaway side view showing the diving mask.
Figure 3:
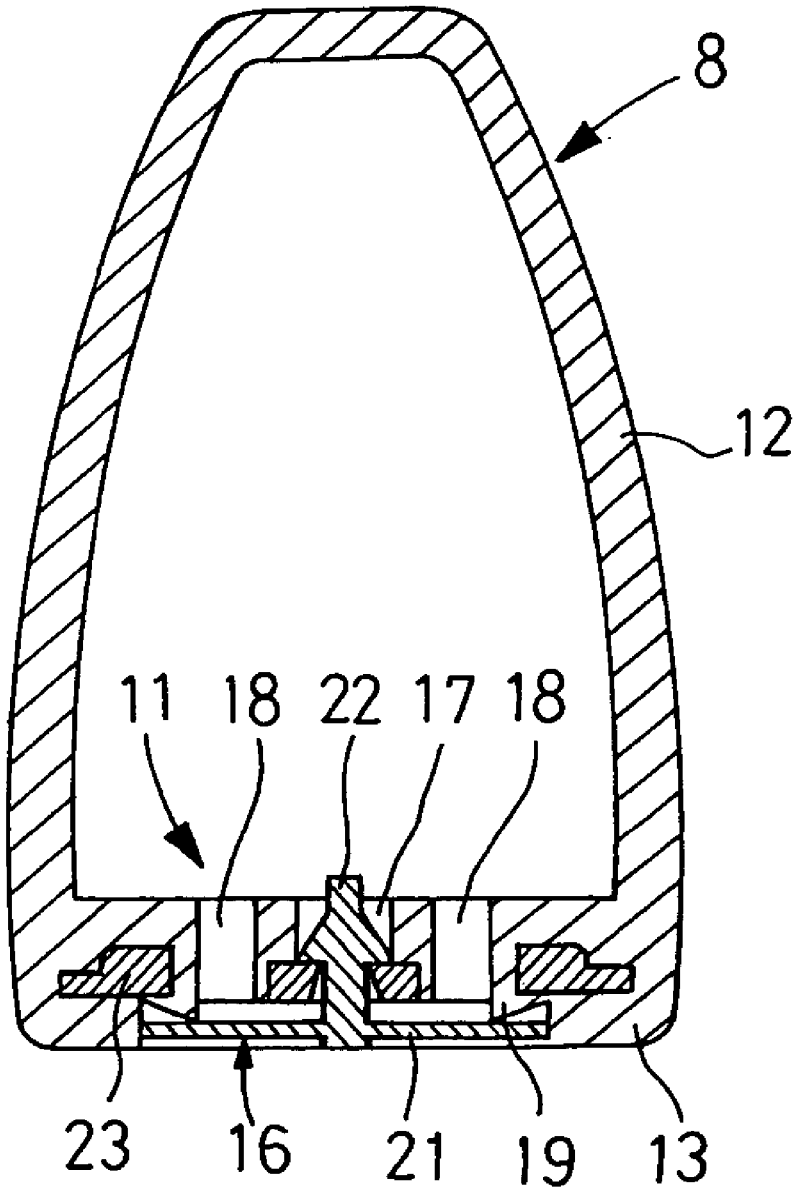
FIG. 3 is a scale-enlarged sectional view taken along the line III-III in FIG. 2.

FIG. 2 is a partially cutaway side view showing the diving mask 1 of FIG. 1 and FIG. 3 is a scale-enlarged sectional view taken along the line III-III in FIG. 2. The nose cover 8 has transversely opposite side walls 12 and a bottom 13 formed with the drainage mechanism 11. The drainage mechanism 11 comprises, in addition to a check valve 16 for drainage formed separately from the bottom 13, a through-hole 17 extending through the bottom 13 to be used for mounting of the check valve 16, a plurality of drain holes 18 arranged around the through-hole 17, spokes 25 radially extending from the through-hole 17, and a valve seat 19 circularly extending outside the drain holes 18 around the through-hole 17. Of these constituents, the through-hole 17, the drain holes 18 and the spokes 25 are indicated by chain lines in FIG. 1. The check valve 16 comprises a disco-lamina 21 and a shaft 22 standing upright from a central zone of the disco-lamina 21 and press-fitted into the through-hole 17 for mounting of the check valve 16. The check valve 16 is formed from a soft and elastically deformable elastomer such as a silicon rubber. In this bottom 13 comprising the through-hole 17, the drain holes 18 and the valve seat 19, the annular member 23 formed from a relatively hard and deformation-resistant material, for example, plastics such as a polycarbonate resin or metallic material is covered with the elastomer forming the skirt 6.

Figure 4:
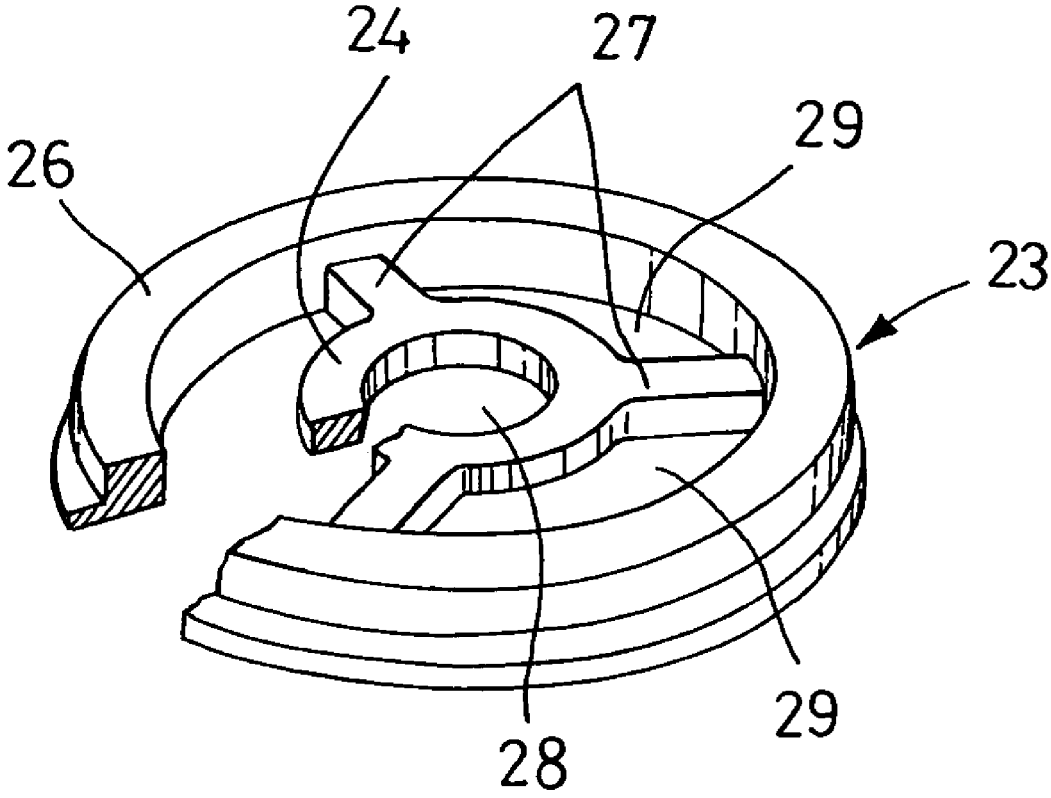
FIG. 4 is a perspective view showing an annular member.

FIG. 4 is a partially cutaway perspective view showing the annular member 23. The annular member 23 comprises an inner annulation 24, an outer annulation 26 and a plurality of spokes 27 connecting these two annulations with each other. The inner annulation 24 surrounds a central through-hole 28 and the spokes 27 circumferentially divide a space defined between the inner annulation 24 and the outer annulation 26 into a plurality of outside through-holes 29. Such annular member 23 is previously set in the die at a predetermined position when the skirt member 6 is injection molded in this die. Upon completion of this molding process, the annular member 23 is fixed to the bottom 13 of the nose cover 8 as illustrated by FIGS. 2 and 3. However, a peripheral edge of a central through-hole 28 surrounded by an inner annulation 24 is not covered with the elastomer and thereby defines the through-hole 17 of the drainage mechanism 11. The outside through-holes 29 respectively have peripheral edges covered with the elastomer and respectively define the drain holes 18 of the drainage mechanism 11. The spokes 27 are covered with the elastomer and respectively define the spokes 25 of FIG. 1. The elastomer forming the nose cover 8 entirely covers the outer annulation 26 of the annular member 23 and, as will be apparent from FIG. 3, the valve seat 19 is formed in the vicinity of the annular member 23.

In the drainage mechanism 11 of the mask 1, the disco-lamina 21 of the check valve 16 is normally held from the outside in close contact with the valve seat 19 of the nose cover 8. To drain off an amount of water accumulated within the nose cover 8, a mask wearer may breathe hard through his or her nose to open the check valve outward. In the drainage mechanism 11 functioning in this manner, the disco-lamina 21 as well as the valve seat 19 of the check valve 16 are formed from the soft elastomer. However, the annular member 23 lying in close proximity to the valve seat 19 is sufficiently hard and deformation-resistant to prevent the valve seat 19 from being significantly deformed and to hold the valve seat 19 in contact with the check valve 16 as closely as the conventional valve seat often formed from a hard material has been the case. In addition, the drainage mechanism 11 according to the present invention is advantageously free from the problem that the valve seat 19 as a part of the annular member 23 might be covered with flash of the elastomer destined to form the nose cover 8 during injection molding of the skirt member 6. This is because that the present invention allows the nose cover 8 to be obtained without reliance upon the conventional process in which the annular member previously formed together with the valve seat by a relatively hard material is set in the die for molding the nose cover so that the annular member may be integrated with the nose cover.

Figure 5:
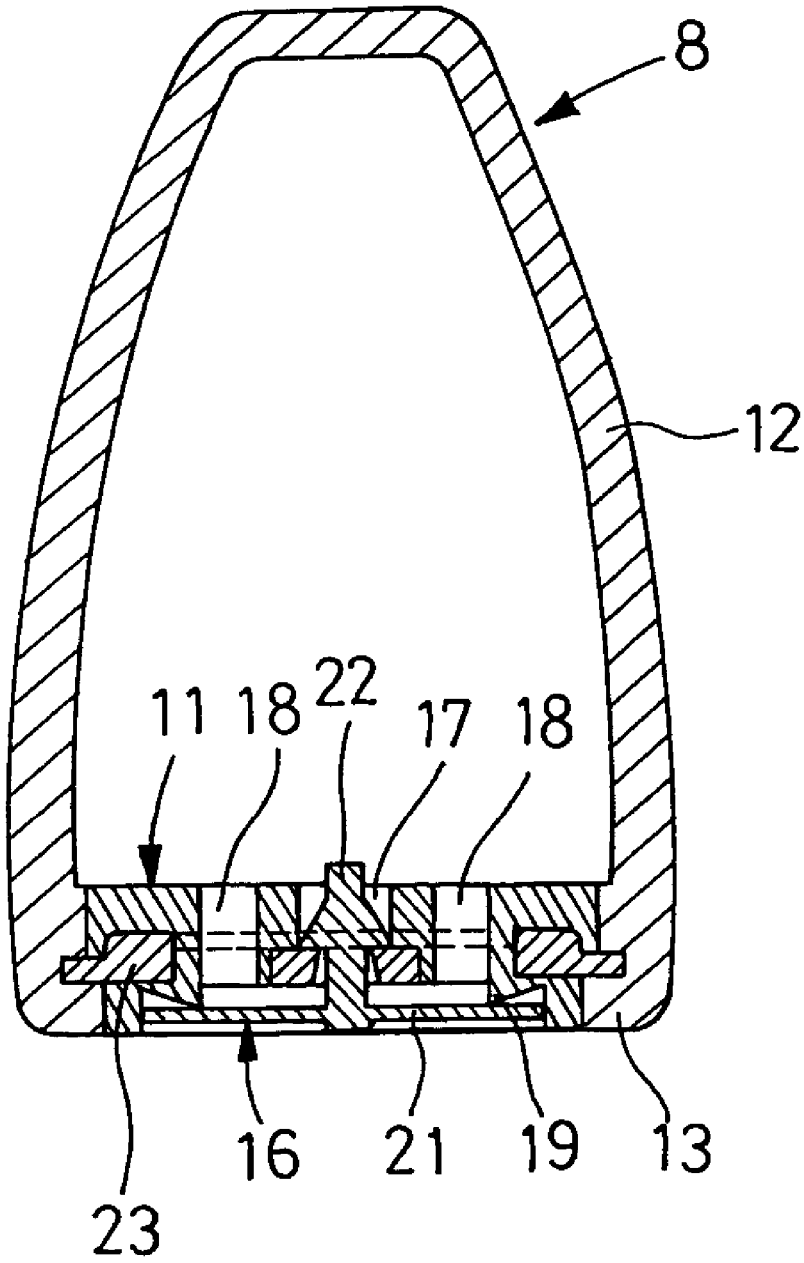
FIG. 5 is a view similar to FIG. 3, showing one preferred embodiment of the invention.
Figure 6:
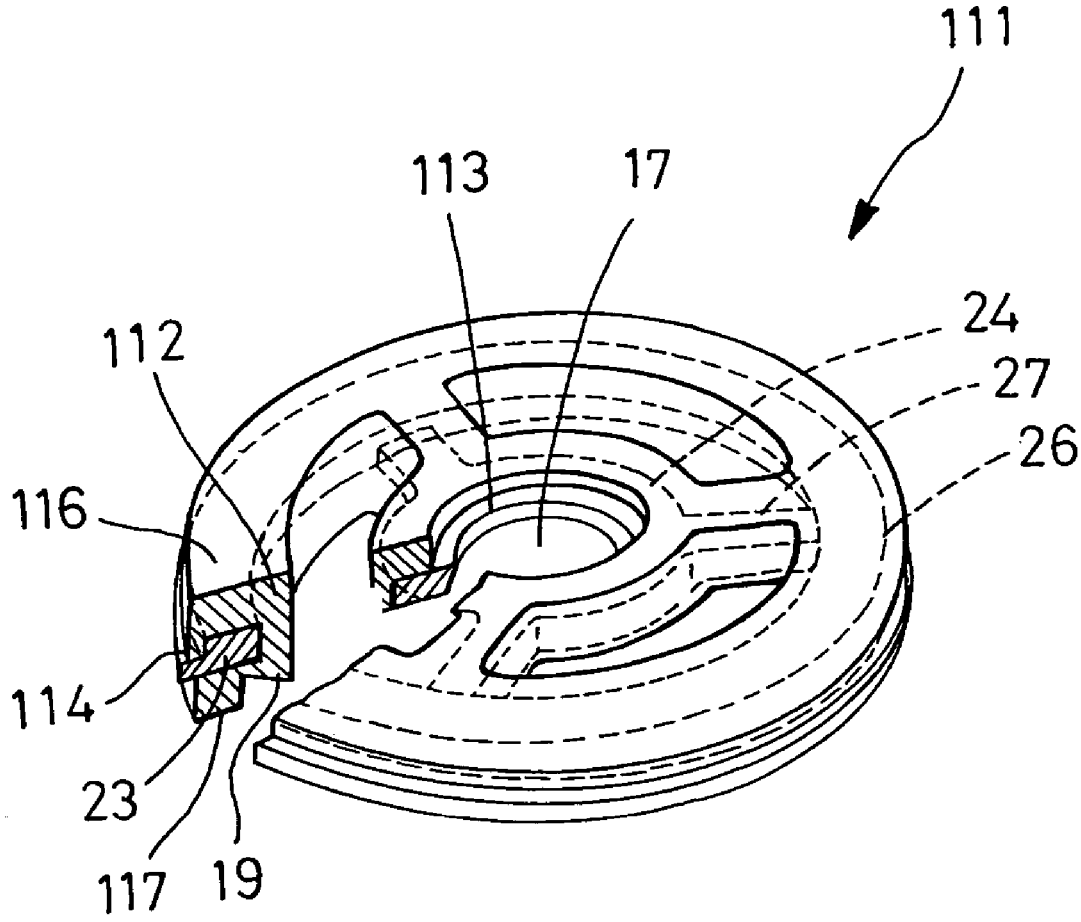
FIG. 6 is a perspective view showing a drainage mechanism as partially broken away.

FIG. 5 is a view similar to FIG. 3, showing another preferred embodiment of the invention and FIG. 6 is a partially cutaway perspective view showing a drainage member 111 destined to form the drainage mechanism 11 of FIG. 5. The drainage mechanism 11 of FIG. 5 is obtained by previously setting the drainage member 111 formed separately from the nose cover 8 in the die for molding of the skirt member 6 so that the drainage member 111 may be integrated with the elastomer for the nose cover 8 within the die. The drainage member 111 comprises the annular member 23 similar to that shown in FIG. 2 and an elastomer 112 partially covering this annular member 23. More specifically, an outer peripheral zone of the inner annulation 24, an inner peripheral zone of the outer annulation 26 and the spokes 27 are covered with the elastomer 112. Of the annular member 23, an inner peripheral zone 113 of the inner annulation 24 and an outer peripheral zone 114 of the outer annulation 26 are exposed. In this drainage member 111, a region to define the through-hole 17 of FIG. 5 has already been formed from hard plastics and a region to define the valve seat 19 of FIG. 5 has already been formed from the elastomer 112. The elastomer 112 may be the same as the elastomer used for molding of the skirt member 6 or a relatively soft elastomer easily weldable to the aforementioned elastomer. When the drainage member 111 is set in the die in order to integrate the drainage member 111 with the nose cover 8, portions of the elastomer 112 covering the outer annulation 26 of the annular member 23 from above and below as viewed in FIG. 6, i.e., the portions 116, 117 shown in FIG. 6 are held tight to prevent the elastomer destined to form the nose cover from flowing inward beyond these portions 116, 117 in the form of flash. Outside these portions 116, 117, on the other hand, the elastomer 112 is integrated with the elastomer forming the nose cover 8. These portions 116, 117 formed from the elastomer 112 ensure that the die can be completely closed even if a thickness of the drainage member 111 more or less exceeds a depth of the die cavity at these portions 116, 117. Furthermore, there is no anxiety that undesirable flash might be created and damage the previously formed valve seat 19.

While description has been made above with respect to the diving mask 1 of twin-lens type, the present invention may be exploited also in the form of a single eyed diving mask. While the illustrated diving mask 1 has the drainage mechanism 11 in the bottom 13 of the nose cover 8, the present invention may be exploited also in the form of a diving mask having the drainage mechanism 11 in any other region, for example, in the vicinity of the nose cover.

The present invention allows the diving mask ensuring the reliable close contact between the check valve and the valve seat for drainage to be easily produced.

What is claimed is:

1. A diving mask having a back-and-forth direction, a transverse direction and a vertical direction being orthogonal one to another, and comprising:

a lens unit including one or more lenses formed from a soft and transparent material and located ahead in said back-and-forth direction;

a skirt member formed from a soft elastic material and extending rearward from said lens unit;

a head-strap member adapted to hold a peripheral edge of said skirt member in close contact with the face of a wearer;

said skirt member being formed in a region corresponding to a middle region of said lens unit as viewed in said transverse direction with a nose cover;

a drainage mechanism which includes a check valve adapted to be opened toward an outside of said skirt member being formed in a bottom of said nose cover or in a vicinity of said nose cover;

said drainage mechanism comprising an inner annulation defining a through-hole adapted to receive a mounting shaft of said check valve, a plurality of drain holes defined around said inner annulation by a plurality of spokes radially extending from said inner annulation and a valve seat extending in a circumferential direction of said inner annulation outside an array of said drain holes and projecting toward said check valve, said valve seat being formed from an elastic material integrated with said soft elastic material forming said skirt member, and an annular member formed from one of a plastic material and a metallic material having a hardness and deformation-resistance both higher than those of the elastic material forming said valve seat being embedded in said bottom of said nose cover in a vicinity of said valve seat so as to extend along said valve seat.

2. The mask as defined by claim 1, wherein said inner annulation of said drainage mechanism has said through-hole formed from the same hard material as the material forming said annular member so that said hard material constituting said inner annulation is connected with said annular member by means of said hard material extending along said spokes.

3. A diving mask having a back-and-forth direction, a transverse direction and a vertical direction being orthogonal one to another, and comprising:

a lens unit including one or more lenses formed from a soft and transparent material and located ahead in said back-and-forth direction;

a skirt member formed from a soft elastic material and extending rearward from said lens unit;

a head-strap member adapted to hold a peripheral edge of said skirt member in close contact with the face of a wearer;

said skirt member being formed in a region corresponding to a middle region of said lens unit as viewed in said transverse direction with a nose cover;

a drainage mechanism which includes a check valve adapted to be opened toward an outside of said skirt member being formed in a bottom of said nose cover or in a vicinity of said nose cover;

said drainage mechanism comprising an inner annulation defining a through-hole adapted to receive a mounting shaft of said check valve, a plurality of drain holes defined around said inner annulation by a plurality of spokes radially extending from said inner annulation and a valve seat extending in a circumferential direction of said inner annulation outside an array of said drain holes and projecting toward said check valve, said valve seat being formed with said nose cover from said soft elastic material, and an annular member formed from one of a plastic material and a metallic material having a hardness and deformation-resistance both higher than those of the elastic material forming said valve seat being embedded in said bottom of said nose cover in a vicinity of said valve seat so as to extend along said valve seat.

4. The mask as defined by claim 3, wherein said inner annulation of said drainage mechanism has said through-hole formed from the same hard material as the material forming said annular member so that said hard material constituting said inner annulation is connected with said annular member by means of said hard material extending along said spokes.

* * * * *